United States Patent [19]

Nakajima et al.

[11] Patent Number: 4,520,626

[45] Date of Patent: Jun. 4, 1985

[54] HYDRAULIC DRIVE SYSTEM FOR SINGLE ROD CYLINDER

[75] Inventors: Kichio Nakajima; Eiki Izumi; Hiroshi Watanabe; Yukio Aoyagi; Kazuo Honma, all of Ibaraki, Japan

[73] Assignee: Hitachi Construction Machinery Co., Ltd., Tokyo, Japan

[21] Appl. No.: 337,283

[22] Filed: Jan. 5, 1982

[30] Foreign Application Priority Data

Jan. 10, 1981 [JP] Japan ..... 56-1614

[51] Int. Cl.[3] ..... F16D 31/02

[52] U.S. Cl. ..... 60/468; 60/475

[58] Field of Search ..... 60/475, 476, 468

[56] References Cited

U.S. PATENT DOCUMENTS

| | | | |
|---|---|---|---|
| 2,480,527 | 8/1949 | Wachter | 60/475 |
| 2,650,473 | 9/1953 | Bridwell et al. | 60/475 |
| 2,657,533 | 11/1953 | Schanzlin et al. | 60/476 |
| 2,716,995 | 9/1955 | Baugh et al. | 60/476 |
| 2,927,429 | 3/1960 | Carlson | 60/475 |
| 3,636,708 | 1/1972 | Karman et al. | 60/475 |
| 3,878,763 | 4/1975 | Lang | 60/468 |
| 4,047,384 | 9/1977 | Saruwatari | 60/476 |

FOREIGN PATENT DOCUMENTS

| | | | |
|---|---|---|---|
| 2706091 | 8/1978 | Fed. Rep. of Germany | 60/475 |

*Primary Examiner*—Stephen F. Husar

*Attorney, Agent, or Firm*—Antonelli, Terry & Wands

[57] ABSTRACT

A hydraulic drive system including a main line, a variable displacement hydraulic pump and another main line connected to a single rod cylinder in a closed hydraulic circuit, and a flushing valve having a first switching position in which one main line is communicated with a low pressure line and a second switching position in which the other main line is communicated with the low pressure line. The flushing valve is operative to maintain at least one of the two main lines in communication with the low pressure line at all times while moving from one switching position to the other switching position, to keep a lock-up phenomenon from taking place in the closed hydraulic circuit. The system further includes a pressure generating device for generating between the two main lines a pressure differential necessary for effecting switching of the flushing valve.

3 Claims, 7 Drawing Figures

HYDRAULIC DRIVE SYSTEM FOR SINGLE ROD CYLINDER

BACKGROUND OF THE INVENTION

This invention relates to a hydraulic drive system for actuating a single rod cylinder, including a closed hydraulic circuit having a hydraulic pump and connected to the cylinder, and more particularly, to a hydraulic drive system equipped with a flushing valve for discharging from the closed hydraulic circuit excess fluid produced therein when the single rod cylinder is actuated.

To actuate a single rod cylinder, a closed hydraulic circuit has been proposed which includes a hydraulic pump, a main line for communicating one port of the hydraulic pump with a rod side port of the single rod cylinder, and another main line for communicating another port of the hydraulic pump with a bottom side port of the single rod cylinder. When a piston rod of the single rod cylinder is withdrawn into the cylinder, the fluid flowing into the cylinder through the rod side port is smaller in flow rate than the fluid flowing from the cylinder through the bottom side port, thereby causing excess fluid to be produced in the closed hydraulic circuit. To discharge the excess fluid from the closed hydraulic circuit, a flushing valve is used which includes two inlet ports respectively connected to the two main lines and one outlet port connected to a fluid tank. In the flushing valve, communication between the two inlet ports and the one outlet port is normally blocked. However, when a predetermined pressure differential is produced between the two main lines, the inlet port connected to the main line of lower pressure is brought into communication with the outlet port, to thereby allow the excess fluid in the closed hydraulic circuit to be returned to the fluid tank.

However, the above mentioned hydraulic drive system utilizing the closed circuit cannot be used to actuate a single rod cylinder connected to an element which reverses a direction of load applying on the cylinder during movement thereof, such as, for example, a shovel or an arm in an earth-moving machine or a construction machine. Suppose that the single rod cylinder is being actuated to move the piston rod into the cylinder by a high pressure fluid from the hydraulic pump. At this time, the main line connected to the bottom side of the cylinder is lower in pressure than the other main line, and the flushing valve is in a position in which it allows the bottom side main line to be connected to the fluid tank, so that the excess fluid is drained from the bottom side main line through the flush valve to the fluid tank. Under such conditions, it may sometimes happen that the direction of a load driven by the single rod cylinder is suddenly reversed so that the single-rod cylinder which has driven the load is driven by the load in the direction in which the piston rod moves into the cylinder. When this occurs, the bottom side main line that has been lower in pressure has its pressure increased while the pressure in the rod side main line is decreased, so that the flushing valve is switched through a neutral position to a position opposite to the position in which it was located. Upon the flushing valve reaching the neutral position, however, the two inlet ports are brought out of communication with the outlet port, so that the excess fluid in the closed hydraulic circuit has nowhere to go. This brings the single rod cylinder to an abrupt halt, thereby causing an inordinately high pressure to be generated in the closed hydraulic circuit and giving a shock referred to as a lock-up phenomenon to the hydraulic drive system. As can readily be appreciated a lock-up phenomenon should be avoided.

SUMMARY OF THE INVENTION

This invention has as its object the provision of a novel hydraulic drive system for a single rod cylinder including a hydraulic pump for driving the single rod cylinder connected to the latter in a closed hydraulic circuit, and a flushing valve for discharging excess fluid in the closed hydraulic circuit therefrom, which drive system is capable of avoiding a lock-up phenomenon even if the flushing valve is switched from one position to another while the single rod cylinder is being driven to move the piston rod into the cylinder.

The aforesaid object is accomplished according to the invention by providing the hydraulic drive system with a construction in which, when the flushing valve is switched from one position to another position, at least one of inlet ports is in communication with an outlet port at all times, and which comprises pressure generating means mounted between one of main lines of the closed hydraulic circuit communicated with a fluid tank through the flushing valve in a normal position, for generating in the main line a pressure necessary for effecting switching of the flushing valve.

DETAILED DESCRIPTION OF THE PREFERRED EMBODIMENTS

Figure 1:
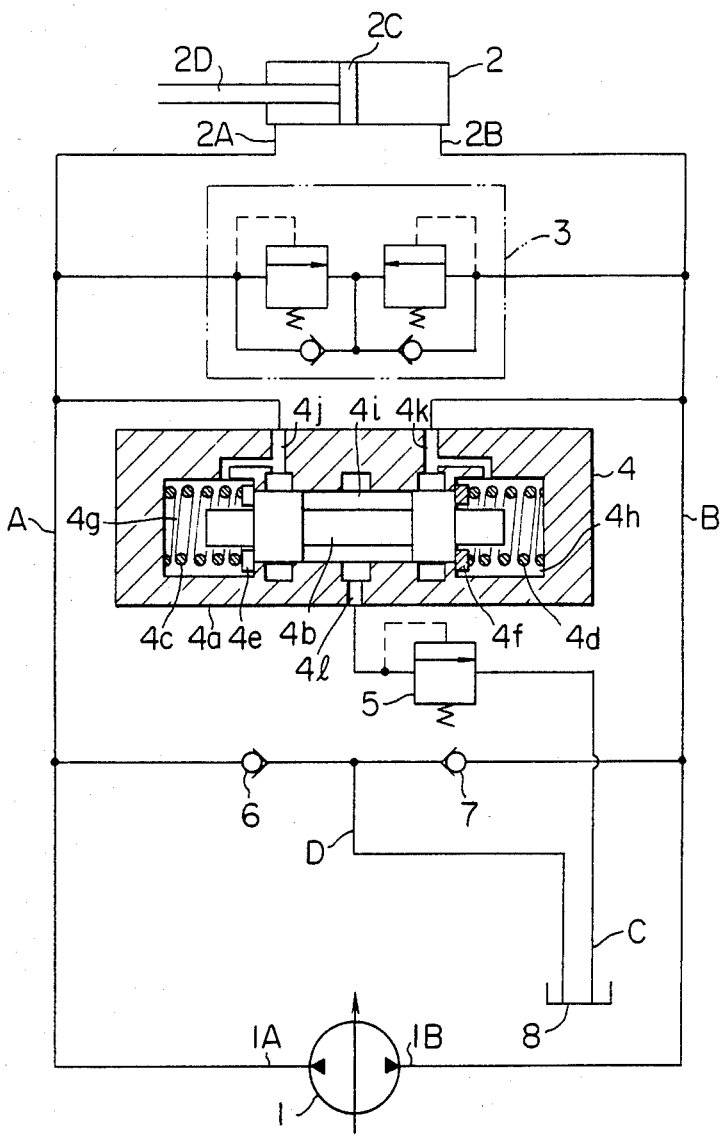
FIG. 1 PRIOR ART
FIG. 1 is a hydraulic circuit diagram of a hydraulic drive system for a single rod cylinder of the prior art.

Referring now to the drawings wherein like reference numerals are used throughout the various views to designate like parts and, more particularly, according to this Figure, a single rod cylinder 2 comprises a piston 2C and a piston rod 2D connected to one side of the piston 2C and extending out of the cylinder 2. The hydraulic drive system for the single rod cylinder 2 comprises a closed hydraulic circuit including a variable displacement hydraulic pump 1, a main line A connecting a port 1A of the pump 1 to a rod side port 2A of the cylinder 2, and another main line B connecting a port 1B of the pump 1 to a bottom side port 2B of the cylinder 2.A crossover relief valve 3 and a flushing valve 4 are connected to the two main lines A and B.

The flushing valve 4 comprises a body 4*a*, a spool 4*b*, springs 4*c* and 4*d*, seats 4*e* and 4*f*, pressure chambers 4*g* and 4*h*, an outlet chamber 4*i*, inlet ports 4*j* and 4*k* and an outlet port 4*l*. Connected to the outlet port 4*l* is a low pressure line C having a relief valve 5 and communicated with a fluid tank 8. The fluid tank 8 is connected through a fluid replenishing line D to the two main lines A and B through check valves 6 and 7.

Pressure fluid in the main lines A and B is introduced into the pressure chambers 4*g* and 4*h* of the flushing valve 4 through the inlet ports 4*j* and 4*k*, respectively. When the pressure differential between the two main lines A and B is small, the flushing valve 4 is maintained in a neutral position by biasing forces of the springs 4*c* and 4*d* and communication between the inlet ports 4*j* and 4*k* and the outlet port 4*l* is blocked. Thus communication between the two main lines A and B and the low pressure line C is blocked. However, when a pressure differential of a higher level than the switching pressure for the flushing valve 4 is generated between the two main lines A and B, a pressure differential is generated between the pressure chambers 4*g* and 4*h* of the flushing valve 4, so that the spool 4*b* moves to a switching position in which the main line lower in pressure alone is connected to the low pressure line C. While the main line A or B is connected to the low pressure line C, the relief valve 5 is brought to an open position to allow the fluid from the main line of the lower pressure to be returned to the fluid tank 8 via the flushing valve 4 and the relief valve 5, if the pressure in the main line of the lower pressure rises above a release pressure or a set pressure for the relief valve 5.

The system shown in FIG. 1 operates in the following manner. Assuming that the piston rod 2D of the signal rod cylinder 2 moves to the right while driving a load, not shown. In this case, pressure fluid of high pressure is discharged through the port 1A of the pump 1 and fed into the cylinder 2 through the port 2A. Thus the main line A has its pressure raised and the spool 4*b* of the flushing valve 4 moves to a right side switching position in which the inlet port 4*k* communicates with the outlet port 4*l*. During the rightward movement of the piston 2C of the cylinder in this condition, the speed of movement of the piston is determined by the flow rate of the fluid discharged from the port 1A of the pump 1 and fed into the cylinder 2 through the port 2A. At this time, the fluid volume discharged from the cylinder 2 through the port 2B into the main line B is greater than the fluid volume fed through the port 2A into the cylinder 2 by an amount corresponding to the volume of the rod 2D, and the fluid volume drawn from the main line B into the pump 1 through the port 1B is equal to the fluid volume discharged from the port 1A of the pump, which in turn, is equal to the fluid volume fed into the cylinder through the port 2A. Thus, in the main line B, excess fluid exists which corresponds in volume to the difference in volume between the fluid discharged through the port 2B of the cylinder 2 and the fluid drawn into the cylinder 2 through the port 2A, or corresponds in volume to the volume of the rod 2D. The excess fluid is returned to the fluid tank through the flushing valve 4 and low pressure line C. Assuming that while the system is in this condition, the direction of the load connected to the piston rod 2D is reversed so that the load forces the rod 2D to the right, the pump 1 would act as a brake and the main line B would have its pressure raised. This would instantly move the spool 4*b* of the flushing valve 4 to the left, so that the spool 4*b* would move from the right side switching position through the neutral position in which it is shown, to a left side switching position. As the spool 4*b* reaches the neutral position during this movement, both the main lines A and B would be shut off from the low pressure line C communicating with the fluid tank 8. Thus, the excess fluid would have nowhere to go and the lock-up phenomenon would occur, so that the single rod cylinder 2 would be suddenly stopped and an inordinately high pressure would be created in the closed hydraulic circuit thereby giving rise to a shock in the system. When the spool 4*b* reaches the left side switching position, the main line A of lower pressure is brought into communication with the low pressure line C. Thus, the fluid discharged into the main line B through the port 2B of the cylinder 2 all flows into the port 1B of the pump 1 and is discharged from the port 1A of the pump 1 into the main line A. A part of the fluid in the main line A is fed into the cylinder 2 through the port 2A and the rest or the excess fluid is returned to the fluid tank 8 through the flushing valve 4 and the low pressure line C. At this time, the speed of movement of the piston 2C is determined by the flow rate discharged from the port 2B of the cylinder and sucked into the port 1B of the pump.

In the system of FIG. 1, the lock-up phenomenon would inevitably occur when the direction of load is reversed during rightward movement of the piston. Thus, the system cannot be used to actuate single rod cylinders installed in an earth-moving machine or construction machine such as a hydraulic shovel.

Figure 2:
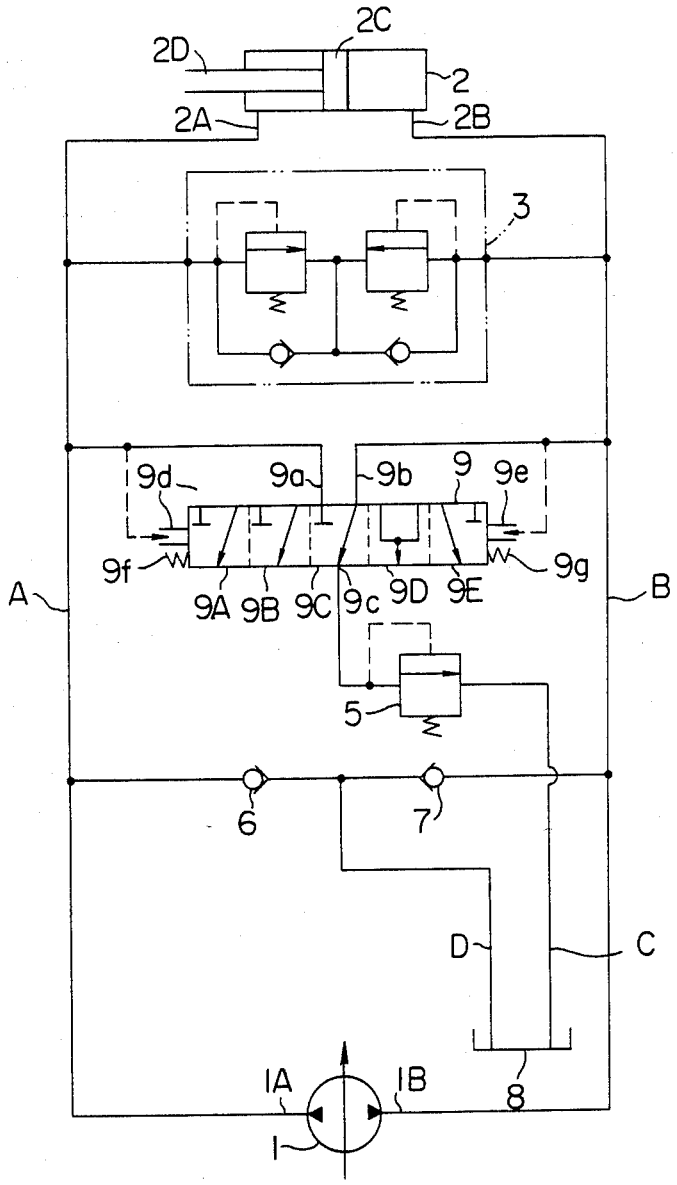
FIG. 2 is a hydraulic circuit diagram of the hydraulic drive system comprising a first embodiment of the invention.

Referring to FIG. 2, in accordance with the present invention, a flushing valve 9 has two inlet ports 9*a* and 9*b* connected to the main lines A and B, respectively, and an outlet port 9*c* connected to the low pressure line C. The flushing valve 9 has switching positions 9A and 9E and a normal or neutral position 9C. Pressure receiving sections 9*d* and 9*e* of the flushing valve 9 have a pressure applied thereto from the main lines A and B, respectively, and when the pressure differential between the main lines A and B is small or normal, the valve 9 is maintained in the neutral position 9C by the equal biasing forces of springs 9*f* and 9*g*. However, when the valve 9 is in the switching position 9A, the main line A is closed and the main line B is connected to the low pressure line C; when the valve 9 is in the switching position 9E, the main line B is closed and the main line A is connected to the low pressure line C, as is the case with the flushing valve 4 of the prior art. In the flushing valve 9 of this embodiment, the main line B is connected to the low pressure line C when the valve 9 is in the neutral position 9C. While the valve 9 is in transitory positions moving from the neutral position 9C to the switching position 9A (hereinafter referred to as a transitory position 9B) the main line B is kept in communication with the low pressure line C. Meanwhile, while the valve 9 is in another transitory position 9D during its movement from the neutral position 9C to the switching position 9E, the main lines A and B are both communicated with the low pressure line C. Thus, no matter what position the flushing valve 9 may assume between the two switching positions 9A and 9E, the valve 9 keeps at least one of the two main lines A and B in communication with the low pressure line C. A relief valve 5 has the function of a pressure generating means for causing a pressure necessary for effecting switching of the flushing valve 9 to be generated in the main line B. The pressure for releasing the valve 5 or the set pressure $P_l$ of the valve 5 is set to be higher than the sum of the switching pressure $P_f$ of the flushing valve 9 and the pressure of fluid supplied through a fluid replenishing line D or the internal pressure Po of the fluid tank 8.

The system shown in FIG. 2 operates in the following manner. Assume that the variable displacement hydraulic pump 1 is actuated to move the piston 2C to the right when the pressure differential between the main lines A and B is smaller than the switching pressure Pf of the flushing valve 9 which is in the neutral position. In this case, the pressure in the main line A rises. Since the main line A is kept out of communication with the low pressure line C by the flushing valve 9, a pressure differential higher than the switching pressure Pf is generated between the two main lines A and B, thereby moving the flushing valve 9 to the switching position 9A. This brings the main line B of lower pressure into communication with the low pressure line C through the flushing valve 9, to drain the excess fluid to the fluid tank 8. Conversely, when the piston 2C is moved to the left, the port 1B of the hydraulic pump 1 serves as a discharge port and the main line B has its pressure raised. At this time, the flushing valve 9 is in the neutral position 9C and the main line B is communicated with the low pressure line C. However, since the relief valve 5 is located in the low pressure line C, the pressure in the main line B rises to a level at least higher than the set pressure $P_1$ of the relief valve 5. Meanwhile, the main line A of lower pressure is communicated with the fluid tank through the check valve 6 and has fluid supplied thereto, so that the internal pressure of the main line A is equal to the pressure Po in the tank 8 even when it is at a maximum. As described hereinabove, $P_l > P_f + P_o$. Thus, a pressure differential higher than the switching pressure $P_f$ of the flushing valve 9 is generated between the two main lines A and B, to thereby move the flushing valve 9 to the switching position 9E and bring the main line B of higher pressure out of communication with the low pressure line C. Accordingly, a desired high pressure is generated in the main line B by the pump 1 and acts on the piston 2C of the cylinder 2 to move same to the left. At this time, the leftward movement of the piston 2C causes fluid to be discharged through the port 2A into the main line A in an amount which is smaller than the fluid flowing into the cylinder 2 through the port 2B. This causes the existence of an insufficient amount of fluid in the main line A which is compensated for by the fluid fed from the fluid tank 8 through the fluid replenishing line D and check valve 6.

As described hereinabove, while the piston 2C of the single rod cylinder 2 is being driven by the hydraulic pump 1 to move to the right in FIG. 2, the main line A has its pressure raised and the main line B has its pressure lowered while the flushing valve 9 is moved to the switching position 9A. When the system is in this condition, the load applied to the rod 2D may have its direction reversed and act in a manner so as to force the rod 2D to move to the right. This causes the main line B to become higher in pressure than the main line A and moves the flushing valve 9 from the switching position 9A to the switching position 9E through the transitory position 9B, neutral position 9C and transitory position 9D. Before the valve 9 reaches the neutral position 9C from the switching position 9A, the main line B is communicated with the low pressure line C at all times and the excess fluid produced by the difference in volume between the fluid discharged through the port 2B of the cylinder 2 and the fluid introduced into the cylinder 2 through the rod side port 2A is drained into the fluid tank 8 from the main line B through the flushing valve 9 and low pressure line C. When the flushing valve 9 is in the transitory position 9D, the two main lines A and B are communicated with the low pressure line C, so that the excess fluid flows from the main lines A and B to the low pressure line C through the flushing valve 9. When the flushing valve 9 is in the switching position 9E, the main line A is communicated with the low pressure line C, so that the excess fluid is drained from the main line A to the low pressure line C through the flushing valve 9. As described hereinabove, while the flushing valve 9 is moving from the switching position 9A to the switching position 9E, at least one of the two main lines A and B is kept in communication with the low pressure line C at all times, so that it is possible to avoid the lock-up phenomenon by draining the excess fluid into the fluid tank 8 through the flushing valve 9 and relief valve 5. Thus, a rise of the internal pressure of the closed hydraulic circuit to an inordinately high level and a shock given to the system as a whole can be avoided.

Figure 3:
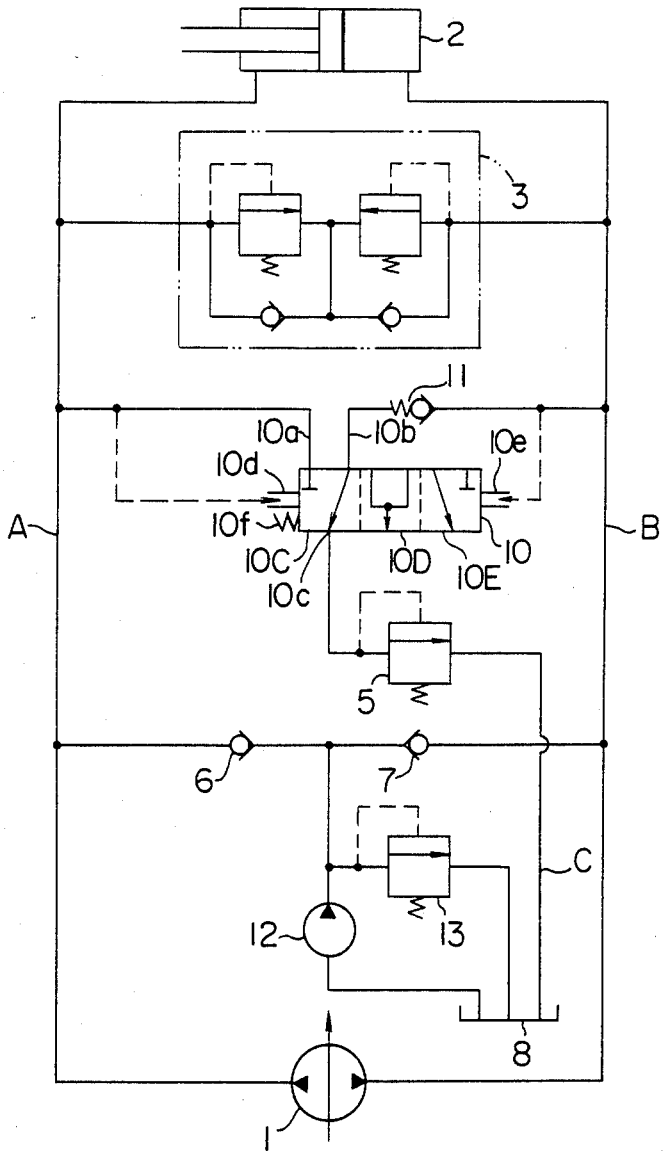
FIG. 3 is a hydraulic circuit diagram of the hydraulic drive system comprising a second embodiment of the present invention.

As shown in FIG. 3 a flushing valve 10 of a spring offset type is used. The flushing valve 9 shown in FIG. 2 is constructed such that its positions 9A, 9B and 9C merely represent different areas of opening, and these positions are integrated into a single position in a flushing valve 10 shown in FIG. 3. Thus, the normal position 10C of the flushing valve 10 serves concurrently as a switching position and a transitory position. The relief valve 5 combined with a check valve 11 is used as pressure generating means. The fluid replenishing means comprises a charge pump 12 and a relief valve 13 for the charge pump 12, in addition to the fluid tank 8. The highest pressure of the charge pump 12 may vary depending on the pressure at which the relief valve 13 is set, and fluid is fed positively to the main lines A and B by the charge pump 12. This arrangement enables the fluid in the closed hydraulic circuit to be replaced by new fluid in a shorter period of time than in the embodiment shown in FIG. 2 in which the tank 8 alone constitutes fluid replenishing means.

In the embodiment shown in FIG. 3, pressures are in the relation $P_1 + P_c > P_f + P_2$, wherein $P_1$ is the pressure at which the relief valve 5 is set, $P_f$ is the switching pressure of the flushing valve 10, $P_c$ is a pressure for opening the check valve 11 or a cracking pressure, and $P_2$ is the pressure at which the relief valve 13 is set. With the pressures having this relationship, when the operation of the pump 1 is started to raise the pressure in the main line B with the flushing valve 10 being in normal position 10C, the pressure in the main line B is equal to $P_1 + P_c$ at a minimum, and the pressure in the main line A on the lower pressure side is $P_2$ at a maximum which is equal to the pressure supplied through the fluid replenishing means. Thus, the pressure differential produced between the two main lines A and B is higher than the switching pressure $P_f$ of the flushing valve 10. This enables the flushing valve 10 to be actuated, to thereby drive the single rod cylinder 2.

Figure 4:
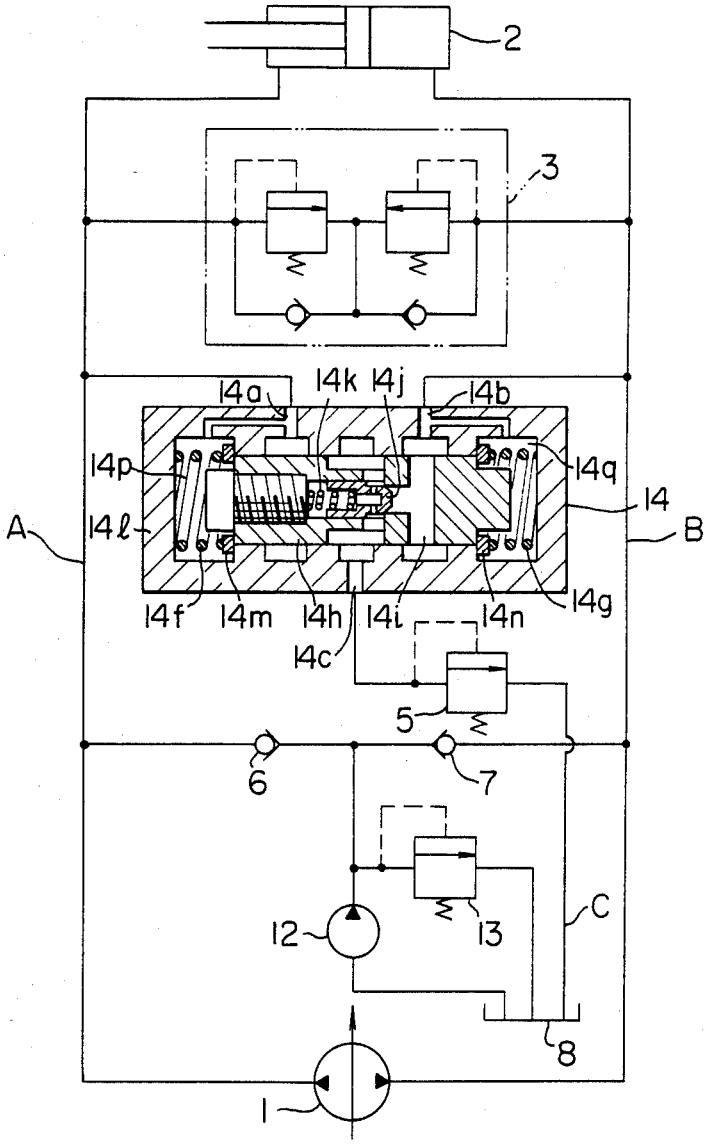
FIG. 4 is a hydraulic circuit diagram of the hydraulic drive system comprising a third embodiment of the present invention.

In FIG. 4 a check valve cooperates with the relief valve 5 to constitute the pressure generating means and is mounted inside a flushing valve 14. A spool **14*h* of the flushing valve 14 is formed with a duct 14*i* communicating an inlet port 14*b* and with an outlet port 14*c* in a neutral position of the valve, which duct 14*i* has mounted therein a check valve including a poppet 14*j*** and a spring 14*k*. In this embodiment, the check valve including the poppet 14*j* and spring 14*k* cooperates with the relief valve 5 to constitute pressure generating means. In the embodiment shown in FIG. 3, the pressure fluid flowing from the main line B to the low pressure line C when the valve 10 is in the switching position 10C flows through the check valve 11, thereby giving rise to a power loss due to the resistance offered by the valve 11 to the fluid. The embodiment shown in FIG. 4 is capable of reducing this power loss because the pressure fluid flowing from the main line B to the low pressure line C when the valve 14 is in a switching position in which the spool 14*h* moves to the right in the figure flows through a path defined by a body 14*l* and the spool 14*h* in place of the duct 14*i* and the check valve. In FIG. 4, 14*f* and 14*g* are springs, 14*m* and 14*n* are seats and 14*p* and 14*q* are pressure chambers.

Figure 5:
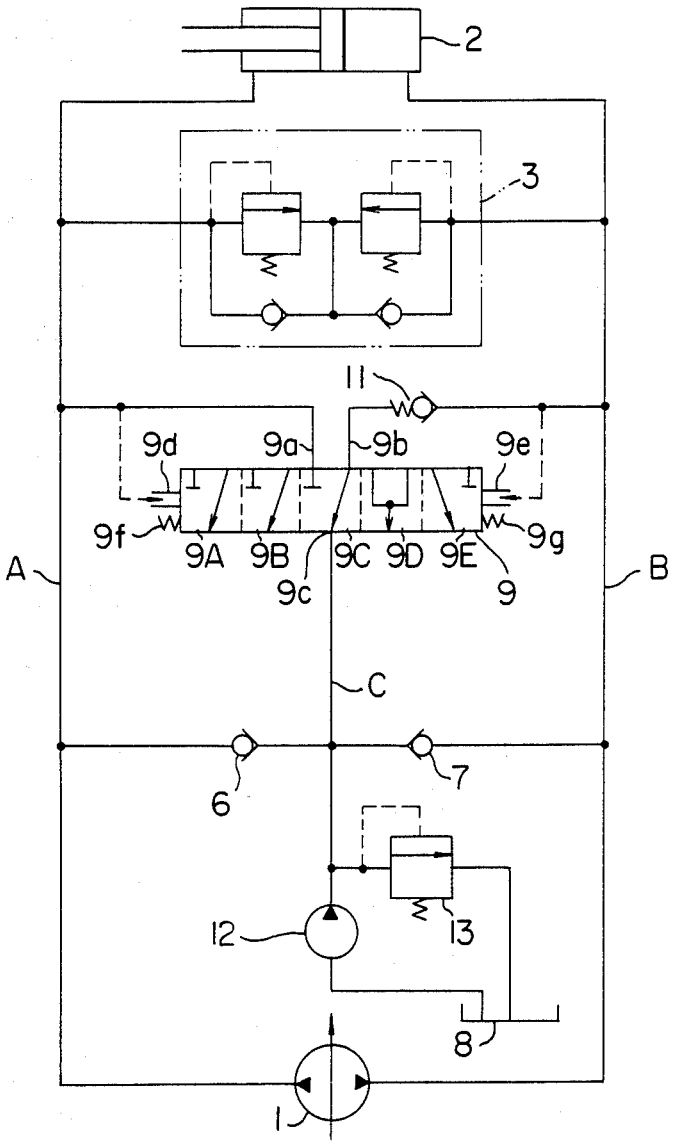
FIG. 5 is a hydraulic circuit diagram of the hydraulic drive system comprising a fourth embodiment of the present invention.

As shown in FIG. 5, the relief valve 13 for charging serves concurrently as the relief valve 5 thereby offering the advantage of the elimination of the relief valve 5 which is conducive to simplification of the circuit, increasing the reliability in performance, and reducing cost.

Figure 6:
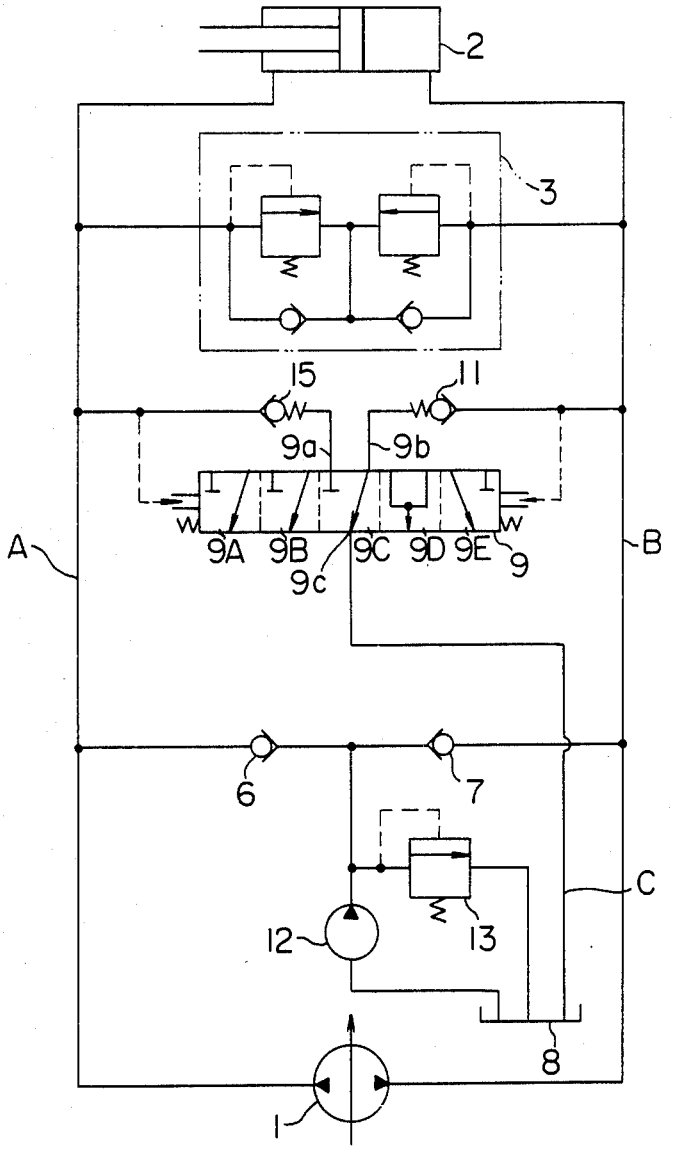
FIG. 6 is a hydraulic circuit diagram of the hydraulic drive system comprising a fifth embodiment of the present invention.

In FIG. 6, the pressure generating means is constituted by the check valve 11 alone. The cracking pressure $P_c$ of the check valve 11 is set such that $P_c > P_f + P_2$. This enables the check valve 11 to generate a pressure high enough to switch the flushing valve 9 to connect the main line B to the fluid tank 8 when the hydraulic pump 1 is actuated with the flushing valve 9 in its neutral position, to drive the single rod cylinder 2. Not being connected in series with a relief valve, the check valve 11 can have its pressure set accurately and mutual interference between the valves can be avoided. A check valve 15 is intended to set a higher pressure for the time when the main line A is connected to the low pressure line C.

Figure 7:
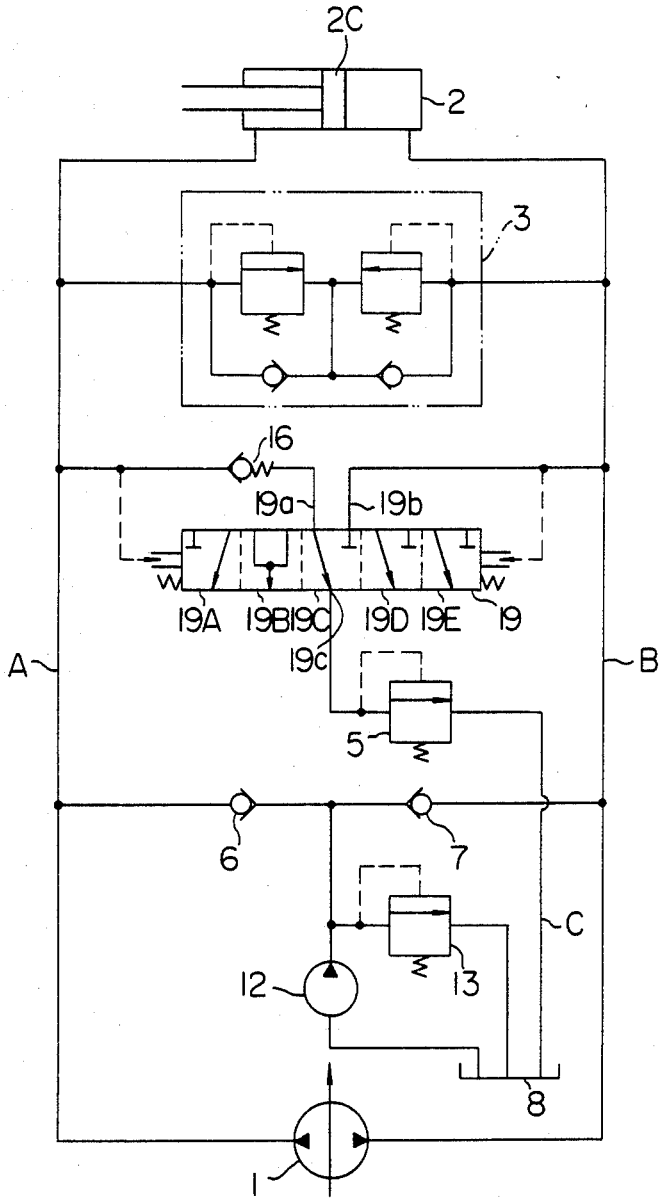
FIG. 7 is a hydraulic circuit diagram of the hydraulic drive system comprising a sixth embodiment of the present invention.

In the embodiments shown in FIGS. 2 to 6, it is the main line B that is connected to the low pressure line C when the flushing valve is in the normal position. However, the invention is not limited to this specific communication between the main line and the low pressure line, and the main line A may be connected to the low pressure line C as shown in FIG. 7 when the flushing valve is in the normal position. In FIG. 7, excess fluid on the rod side of the single rod cylinder 2 is drained to the tank 8 through a check valve 16, flushing valve 9 and relief valve 5. In this embodiment, the check valve 16 and relief valve 5 constitute pressure generating means.

In the second embodiment shown in FIG. 3, the fluid flowing through the check valve 11 or the excess fluid is maximized in volume when the variable displacement hydraulic pump 1 is operated at a maximum swash-plate tilting angle, to move the piston rod 2D in a direction in which it is moved into the cylinder 2 while the pressure in the main line A is higher than the pressure in the main line B. Meanwhile in the embodiment shown in FIG. 7, it is when the variable displacement hydraulic pump 1 is operated at a maximum swash-plate tilting angle to move the rod 2D into the cylinder 2 while the pressure in the main line B is higher than the pressure in the main line A, that the volume of the fluid flowing through the check valve 16 or the excess fluid is maximized. Since the speed of movement of the piston at this time is smaller than that of the embodiment of FIG. 3, the maximum excess fluid generated in the embodiment of FIG. 7 is smaller than that of FIG. 3. Therefore, the fluid volume flowing through the check valve 16 is smaller than the fluid volume flowing through the check valve 11 in FIG. 3, so that a check valve of a lower capacity can be used as the check valve 16.

It is to be understood that the invention is not limited to the check and relief valves shown and described in the embodiments as functioning as pressure generating means, and that a throttle valve may be used singly or in combination with a check valve or a relief valve as pressure generating means.

From the foregoing description, it will be appreciated that according to the present invention at least one of the two main lines of the closed hydraulic circuit is connected to the low pressure line at all times while the flushing valve is being moved from one switching position to another switching position. By this arrangement, the trouble of the fluid being locked up in the closed hydraulic circuit can be avoided and an inordinate rise in pressure and production of a shock can be prevented even when the direction of a load is reversed while the single rod cylinder is being operated in a direction in which its rod is moved into the cylinder, to thereby move the flushing valve from one switching position to another switching position. It will also be appreciated that according to the invention, the pressure generating means is mounted in a path of pressure fluid from the main line to the low pressure line connected together when the flushing valve is in its normal position for generating in the main line a pressure by the passage of pressure fluid therethrough, at a level higher than the sum of the switching pressure of the flushing valve and the pressure of fluid replenishing means. By this arrangement, it is possible to generate between the two main lines a pressure differential high enough to effect switching of the flushing valve at start-up of the hydraulic pump even if the flushing valve is in a normal position, to thereby enable the single rod cylinder to be positively actuated.

What is claimed is:

1. A hydraulic drive system for a single rod cylinder formed with a rod side port and a bottom side port, including:

a hydraulic pump formed with two ports;

a rod side main line fluidly connecting one of said two ports of said hydraulic pump to the rod side port of said single rod cylinder;

a bottom side main line fluidly connecting the other port of said hydraulic pump to the bottom side port of said single rod cylinder;

fluid replenishing means for replenishing said main lines with a working fluid;

a flushing valve formed with two inlet ports respectively connected to said two main lines and one outlet port for communicating the inlet port of a lower pressure with said one outlet port; and a low pressure line connecting said outlet port of said flushing valve to a fluid tank;

characterized in that said flushing valve is displaceable between a normal position and first and second switching positions while maintaining communication between at least one of the inlet ports and the outlet port, said flushing valve is located in the normal position when the hydraulic pump is stopped so that one of the inlet ports is communicated with the outlet port, said flushing valve is displaced from the normal position when the hydraulic pump is actuated to the first switching position in which one inlet port is communicated with the outlet port and to the second switching position in which the other inlet port is communicated with the outlet port so that said rod cylinder is held at a stopped position against an external force being applied thereto by means of said flushing valve, and in that a pressure means is mounted in said low pressure line wherein said low pressure line is located in a path communicating one of the main lines to the fluid tank, for causing an increase in pressure in the main line connected to the inlet port communicated with the outlet port when the flushing valve is in the normal position to displace the flushing valve to one of the switching positions, whereby said flushing valve drains excess fluid from said main line of a lower pressure.

2. A hydraulic drive system as claimed in claim 1, wherein said flushing valve comprises a spool valve operative to effect switching when a pressure differential between the rod side main line and the bottom side main line exceeds a predetermined switching pressure.

3. A hydraulic drive system for a single rod cylinder formed with a rod side port and a bottom side port, including:

a hydraulic pump formed with two ports;

a rod side main line fluidly connecting one of said two ports of said hydraulic pump to the rod side port of said single rod cylinder;

a bottom side main line fluidly connecting the other port of the hydraulic pump to the bottom side port of said single rod cylinder;

fluid replenishing means for replenishing said main lines with a working fluid;

a flushing valve formed with two inlet ports respectively connected to said main lines, and one outlet port for communicating the inlet port of a lower pressure side with said one outlet port; and a low pressure line connecting said outlet port of said flushing valve to a fluid tank;

characterized in that said flushing valve is constructed in such a manner that while the valve is being moved from a first switching position in which one of the inlet ports is communicated with the outlet port to a second switching position in which the other inlet port is communicated with the outlet port so that said rod cylinder is held at a stopped position against an external force being applied thereto by means of said flushing valve, at least one of the inlet ports is maintained in communication with the outlet port, and in that a pressure means is mounted in a path of the working fluid from one of the main lines to the fluid tank, said one of the main lines being connected to the inlet port of the flushing valve communicated with the outlet port of the flushing valve when the flushing valve is in a normal position, to increase pressure in said one of said main lines to displace the flushing valve to one of the switching positions; said pressure means comprises a relief valve mounted in said low pressure line, said relief valve having a release pressure set at a higher level than a sum of a replenishing pressure of the fluid replenishing means and a switching pressure of said flushing valve, whereby said flushing valve drains excess fluid from said main line of a lower pressure.

* * * * *